US007000293B2

(12) United States Patent
Lin

(10) Patent No.: US 7,000,293 B2
(45) Date of Patent: Feb. 21, 2006

(54) CONCEALABLE ZIPPER SLIDER STRUCTURE

(76) Inventor: Yu-Pau Lin, No. 151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 10/882,158

(22) Filed: Jul. 2, 2004

(65) Prior Publication Data

US 2006/0000066 A1 Jan. 5, 2006

(51) Int. Cl.
*A44B 19/26* (2006.01)

(52) U.S. Cl. ..... 24/415; 24/430

(58) Field of Classification Search ..... 24/430, 24/427, 415, 387, 436, 429, 431
See application file for complete search history.

(56) References Cited

U.S. PATENT DOCUMENTS

| | | | | | |
|---|---|---|---|---|---|
| 2,274,723 | A * | 3/1942 | Morin | 24/424 |
| 2,502,055 | A * | 3/1950 | Morin | 24/421 |
| 2,621,387 | A * | 12/1952 | Williams | 24/386 |
| 4,048,699 | A * | 9/1977 | Kanzaka | 24/421 |
| 4,123,829 | A * | 11/1978 | Takabatake | 24/386 |
| 4,819,308 | A * | 4/1989 | Baroky | 24/415 |
| 5,031,286 | A * | 7/1991 | Kedzierski | 24/421 |
| 5,031,944 | A * | 7/1991 | Keyaki | 292/307 R |
| 5,086,546 | A * | 2/1992 | Aoki et al. | 24/429 |
| 5,625,928 | A * | 5/1997 | Terada et al. | 24/424 |
| 5,996,188 | A * | 12/1999 | Yaguramaki et al. | 24/424 |
| 6,622,351 | B1 * | 9/2003 | Takasawa | 24/415 |
| 6,647,598 | B1 * | 11/2003 | Lin | 24/420 |
| 2003/0154578 | A1 * | 8/2003 | Tenjin | 24/430 |

* cited by examiner

*Primary Examiner*—Robert J. Sandy
*Assistant Examiner*—Andre' L. Jackson
(74) *Attorney, Agent, or Firm*—Rosenberg, Klein & Lee

(57) ABSTRACT

A concealable zipper slider is described. The concealable zipper has a slider body with a bottom part, two lateral ribs and two top parts. A connecting portion protrudes from the bottom part, two sliding slits are formed between the bottom part and the two top parts at two sides of the connecting portion, and the connecting portion has dovetail slit. A nose part has a nose body and a dovetail base. The dovetail base of the nose part engages in the dovetail slit of the slider body. The zipper slider thereby is formed by assembly of separate slider body and nose part, which allows automated manufacture, reduces the manufacturing cost and permits variety in the aesthetic appearance thereof by the use of different materials and colors.

21 Claims, 6 Drawing Sheets

CONCEALABLE ZIPPER SLIDER STRUCTURE

BACKGROUND OF THE INVENTION

1. Field of the Invention

The invention relates to a concealable zipper slider. More particularly, the invention relates to a zipper slider that is formed by assembly of separate slider body and nose part, which allows automated manufacture, reduces the manufacturing cost and permits variety in the aesthetic aspect appearance thereof by the use of different materials and colors.

2. Description of the Related Art

Zipper sliders can be conventionally used on baggage zippers. The zipper slider can be provided with a tab that allows convenient pulling of the zipper slider to open or close the zipper.

Referring to FIG. 1, a conventional concealable zipper slider includes a slider body 80 and a nose part 81. The nose part 81 is integrally connected with the slider body 80 in one piece, and has a nose body 82 pivotally mounted with the tab 84 for conveniently pulling the zipper slider. A locking ring 83 is further integrally connected with an end of the nose body 82. The locking ring 83 has an annular shape through which a lock can be passed.

The locking ring 83 of the zipper slider can be aligned with the locking ring 83 of a second zipper slider provided on the zipper, so that a lock can engage through the two locking rings 83 to attach securely the two sliders and prevent unwanted opening of the baggage zipper.

Unfortunately, the conventional design of the slider body and nose part in a one integral piece results in a complex structure of the zipper slider, which requires a complex mold design and results in a higher manufacturing cost of the zipper slider.

The design in a single body further limits the zipper slider and nose part to be made of a same material and color, which does not permit variety in the aesthetic appearance thereof.

SUMMARY OF THE INVENTION

It is therefore an object of the invention to provide a concealable zipper slider structure that is formed by securely assembling separate slider body and nose part. The manufacture of the zipper slider according to the invention can be automated, molding of the zipper slider can be simplified and its manufacturing cost reduced.

It is another object of the invention to provide a zipper slider that allows the use of different materials and different colors for the slider body and the nose part to improve the aesthetic aspect of the zipper slider.

To achieve the above and other objectives, a concealable zipper slider of the invention comprises the following elements. A slider body includes a connecting portion and two sliding slits, where the sliding slits are located at two sides, of the connecting portion, and the connecting portion has a dovetail slit. A nose part includes a nose body and a dovetail base, where the dovetail base of the nose part engages in the dovetail slit of the slider body.

A concealable zipper slider according to another embodiment of the invention comprises the following elements. A slider body includes a bottom part, two lateral ribs and two top parts, where a connecting portion protrudes from the bottom part, two sliding slits are formed between the bottom part and the two top parts at two sides of the connecting portion, and the connecting portion has a dovetail slit. A nose part includes a nose body and a dovetail base, where the dovetail base of the nose part engages in the dovetail slit of the slider body.

The design of the zipper slider by assembly of separate slider body and nose part simplifies the mold for the same and reduces the cost thereof. In addition, the slider body and the nose part can be made of different materials and different colors to improve the aesthetic appearance of the zipper slider.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF PREFERRED EMBODIMENTS

Figure 1:
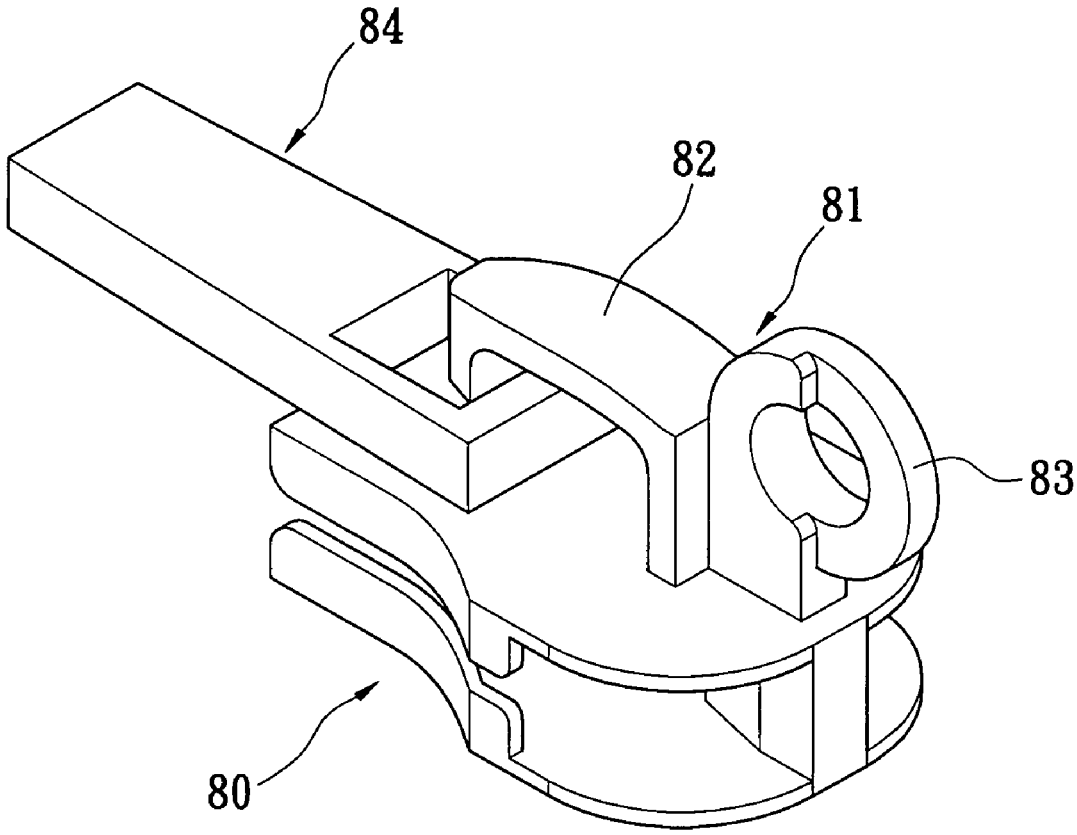
FIG. 1 PRIOR ART
FIG. 1 is a perspective view of a conventional zipper slider connected with a tab.
Figure 2:
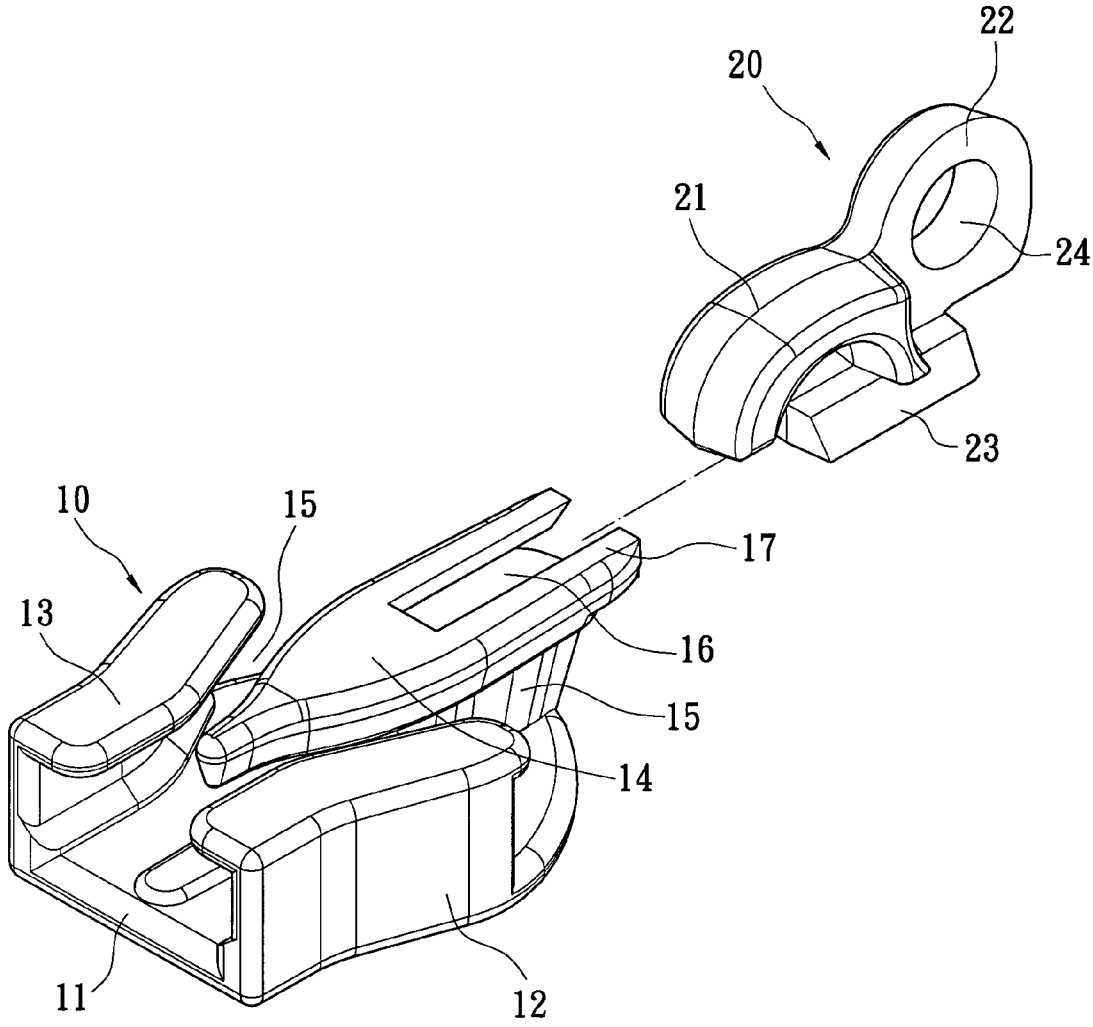
FIG. 2 is an exploded view of a concealable zipper slider according to an embodiment of the invention.
Figure 3:
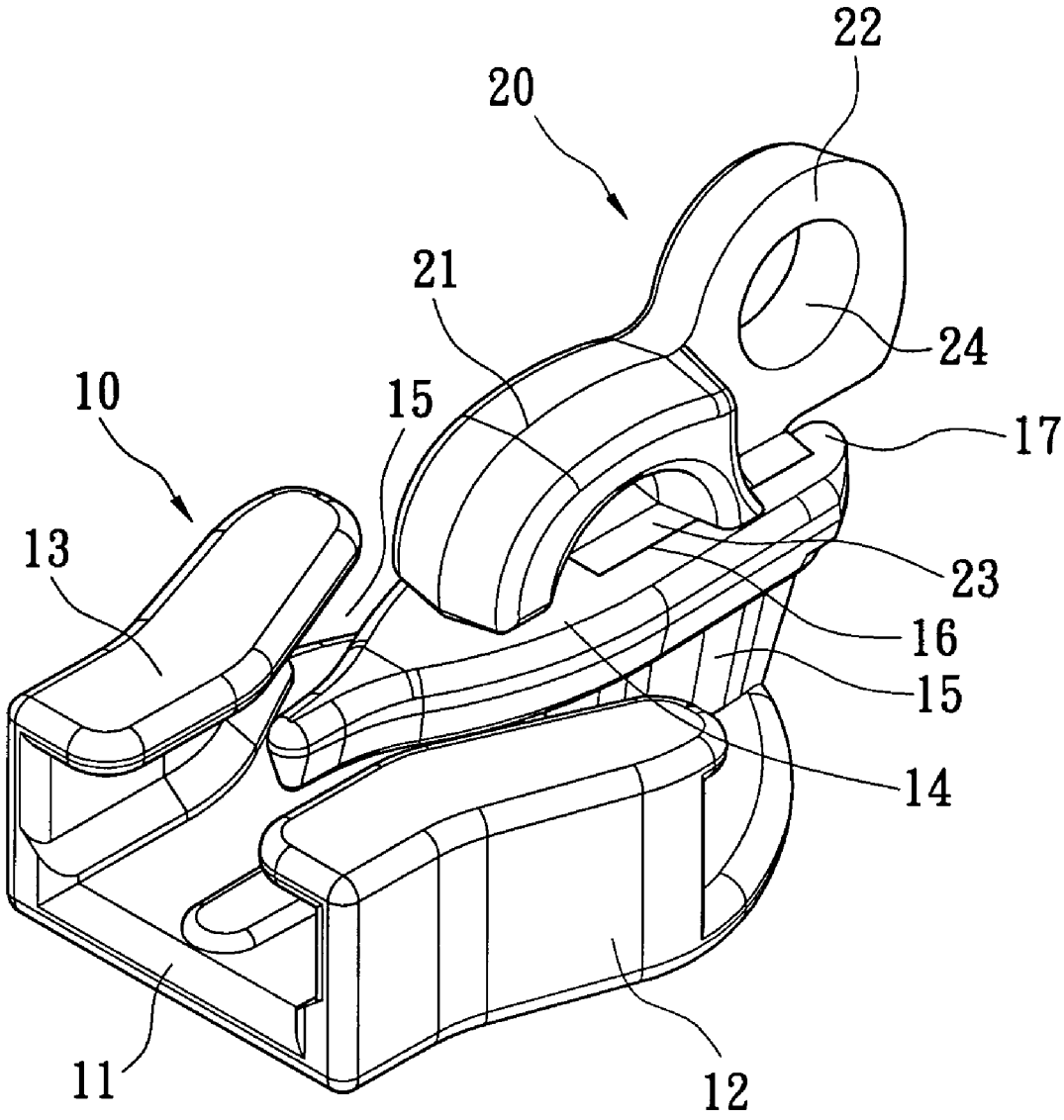
FIG. 3 is a perspective view of a concealable zipper slider according to an embodiment of the invention.
Figure 4:
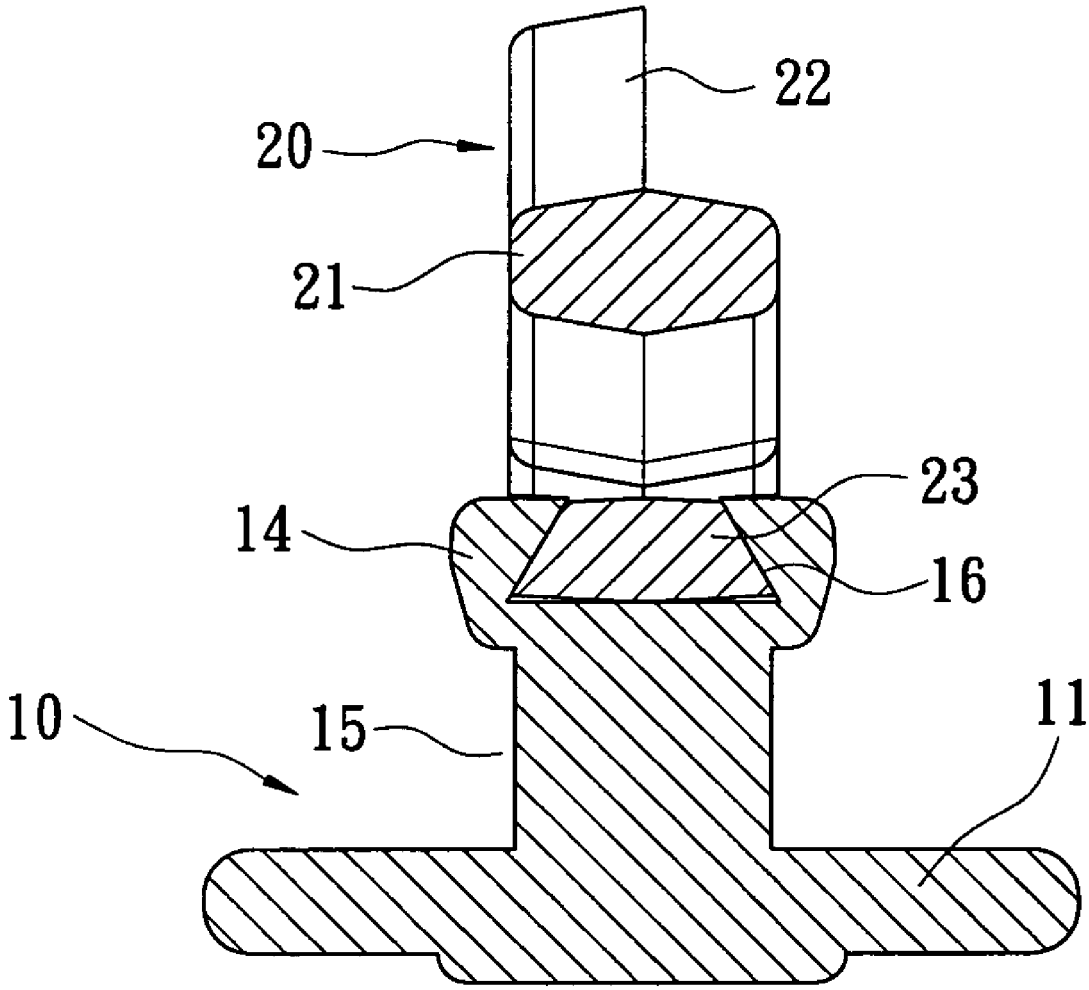
FIG. 4 is a cross-sectional view of a concealable zipper, slider according to an embodiment of the invention.

Referring to FIG. 2, FIG. 3 and FIG. 4, the invention provides a concealable zipper slider structure made of two component parts. The zipper slider includes a slider body 10 and a nose part 20. The slider body 10 has a bottom part 11 with arcuate peripheral edges. Lateral ribs 12 extend upward at an adequate height and in a single body from left and right sides of the bottom part 11. Upper ends of the lateral ribs 12 project horizontally inward to integrally form two top parts 13. The two top parts 13 lie over the bottom part 11 at a height, and are separated from each other by a gap.

A connecting portion 14 protrudes from the bottom part 11, and two sliding slits 15 are formed between the bottom part 11 and the two top parts. The two sliding slits 15 are located inside the slider body 10 at two sides of the connecting portion 14. The two sliding slits 15 can receive the two teeth tapes of the zipper (not shown), so that the slider body 10 can be used to control zipper opening and closing. Because the structure of the slider body 10 described above is approximately similar to that of the conventional zipper slider, no further details are given here.

A slit 16 in the shape of a dovetail is opened in the connecting portion 14. The dovetail slit 16 is defined by extensions of the connecting portion 14 inwardly towards a central area. Another part and a top of the dovetail slit 16 form an opening. Securing parts 17 are bent by stamping at two sides of the connecting portion 14 adjacent to the opening of the dovetail slit 16. The two securing parts 17 are formed as protrusions. The two securing parts 17 can be bent inward by stamping after the slider body 10 connects to the nose part 20, and thereby achieve positional stopping.

The nose part 20 includes a nose body 21, a locking ring 22 and a dovetail-shaped base 23. The nose body 21 is formed in a lengthwise curved body. The locking ring 22 has an annular shape inwardly forming a through hole 24. The locking ring 22 is integrally connected with an end of the nose body 21. The dovetail base 23 is shaped to match the dovetail slit 16, and is integrally connected with a bottom of the connecting area between the nose body 21 and the locking ring 22.

The dovetail base 23 is inserted at an end of the dovetail slit 16 to fit and be secured inside the dovetail slit 16. This connection allows secure assembly of the nose part 20 with the slider body 10. The two securing parts 17 then are bent inward and abut against an end of the dovetail base 23 to stop and secure the position of the dovetail base 23, which thereby is prevented from sliding and disengaging from the dovetail slit 16. The nose part 20 and the slider body 10 can be thereby fixedly secured to each other to form the concealable zipper slider.

Figure 5:
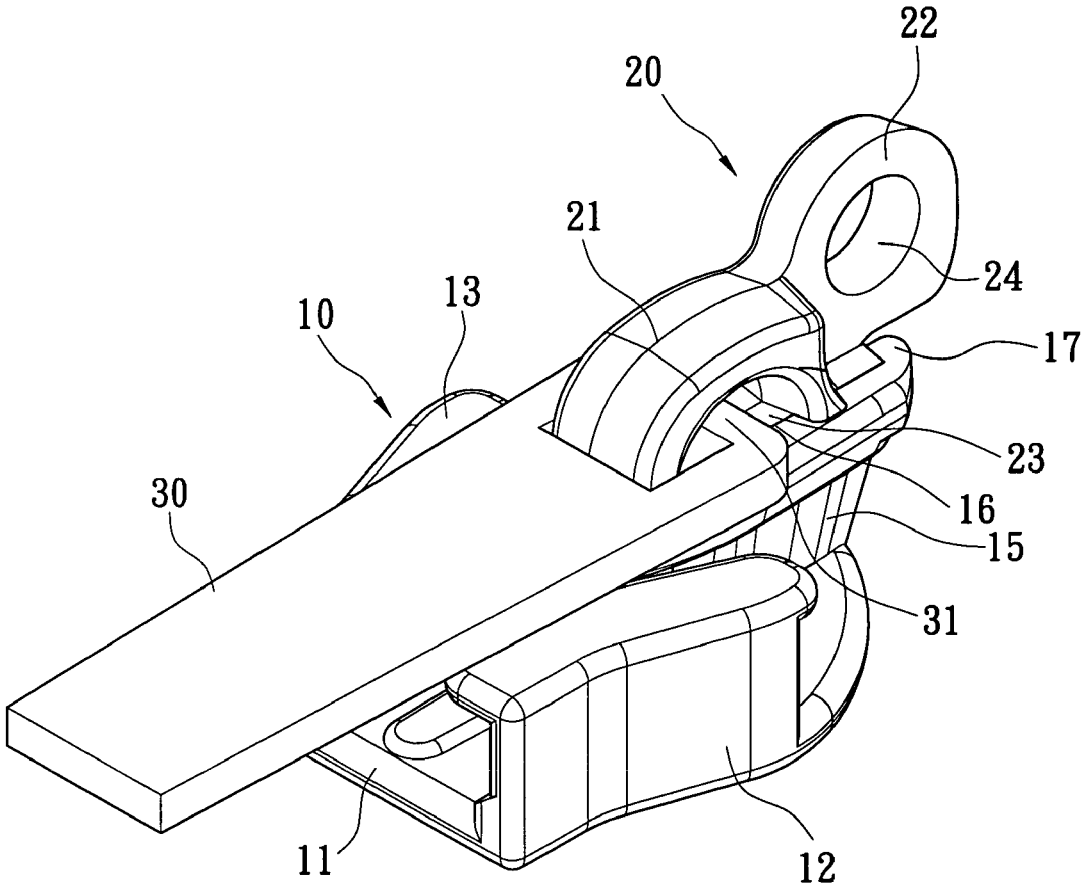
FIG. 5 is a perspective view of a concealable zipper slider mounted with a tab according to an embodiment of the invention.

As shown in FIG. 5, a tab 30 can be further assembled with the slider. Pivoting end 31 of tab 30 is pivotally mounted on the nose body 21. The slider can be thereby pulled with the tab 30 to achieve opening and closing. The tab 30 can have any shape according to the design demand.

The concealable zipper slider of the invention can be mounted on baggage zippers for opening and closing thereof, and can be further provided with a locking ability. The locking ring 22 of the nose body 20 can be aligned with the locking ring 22 of a second zipper slider provided on the zipper, so that a lock can engage through the two locking rings 22 to attach securely the two sliders. Unwanted opening of the baggage zipper can be thereby prevented.

Figure 6:
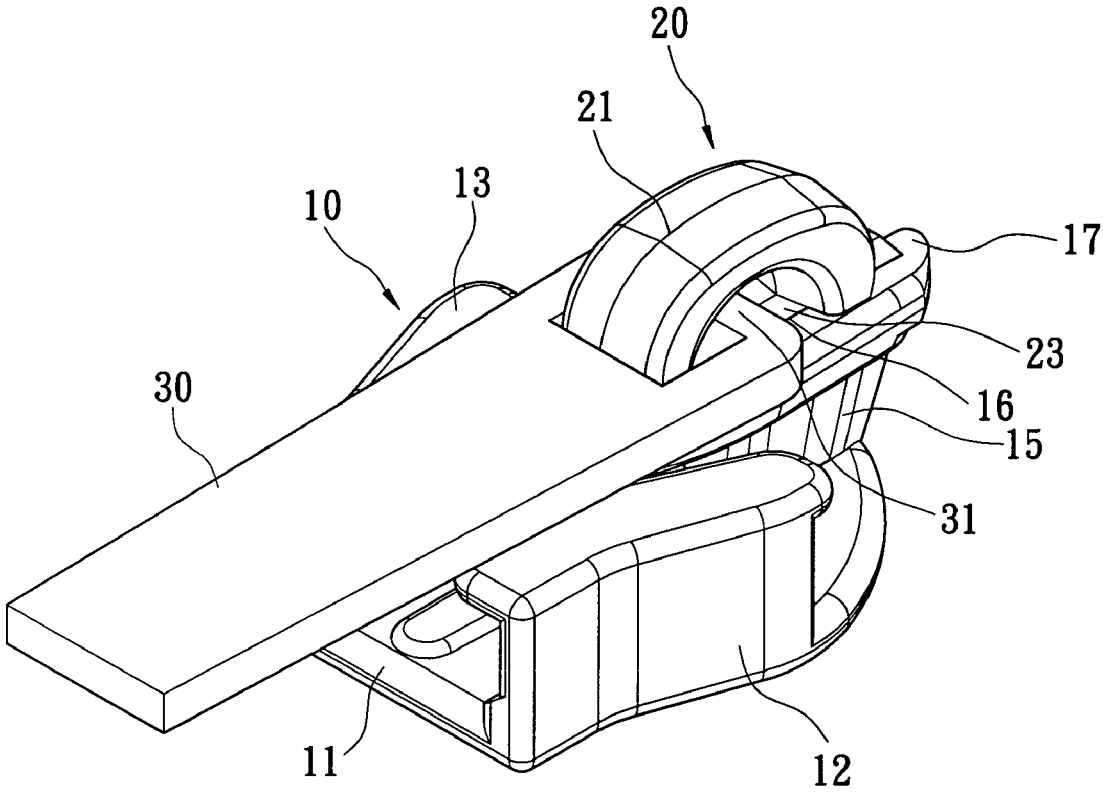
FIG. 6 is a perspective view of a concealable zipper slider according to another embodiment of the invention.

As shown in FIG. 6, the locking ring 22 can be omitted if no locking is desired for the zipper.

As described above, the concealable zipper slider of the invention is formed via assembly of two component parts including a slider body 10 and a nose part 20. The slider body 10 and nose part 20 can be separately manufactured. As a result, the mold fabrication is easier, can be implemented in automatic manufacture, and has a lower cost. Further, the configurations of the dovetail slit/base 16, 23 enable secure mounting of the slider body 10 and nose part 20 that can sustain a relatively strong pulling force without being disengaged.

In addition, the separate design of the slider body 10 and nose part 20 allows using either same or different materials and color designs to permit variety in the aesthetic appearance of the zipper slider.

In conclusion, the invention can improve the design of the conventional concealable zipper slider, which is formed in a single body and consequently requires complex and costly molding and further is disadvantageously limited to the use of a same material and color.

It should be apparent to those skilled in the art that the above description is only illustrative of specific embodiments and examples of the invention, and should not be construed in a limiting way. Therefore, the invention should cover various modifications and variations made to the herein-described structure and operations of the invention, provided they fall within the scope of the invention as defined in the following appended claims.

What is claimed is:

1. A concealable zipper slider, comprising:

a slider body including a bottom part, two lateral ribs and two top parts, the slider body having a connecting portion protruding from the bottom part, two longitudinally directed sliding slits being respectively formed between the bottom part and the two top parts at two sides of the connecting portion, and the connecting portion having a longitudinally extended slit formed therein, the slit defining a dovetail shaped mortise; and a nose part having a nose body and a longitudinally extended base extending from a lower portion thereof, the base defining a dovetail shaped tenon, the base of the nose part being non-displaceably affixed in the slit of the slider body.

2. The concealable zipper slider of claim 1, wherein the bottom part, the two lateral ribs and the two top parts of the slider body are formed in a single body, the two lateral ribs extending upward from two sides of the bottom part, and the two top parts project horizontally inward from upper ends of the lateral ribs.

3. The concealable zipper slider of claim 1, wherein an end and a top of the connecting portion are open to the slit, and an end of the connecting portion forms two securing parts, the two securing parts bending inwardly to abut against an end of the base.

4. The concealable zipper slider of claim 1, wherein the nose part further includes a locking ring connected to an end of the nose body, the base being connected to a bottom of a connecting area between the nose body and the locking ring.

5. The concealable zipper slider of claim 4, wherein the locking ring forms a through hole.

6. The concealable zipper slider of claim 1, wherein the slider body and the nose part are of different materials.

7. The concealable zipper slider of claim 1, wherein the slider body and the nose part are of different colors.

8. The concealable zipper slider of claim 1, wherein the slider body and the nose part are of a same material.

9. The concealable zipper slider of claim 1, wherein the slider body and the nose part are of a same color.

10. The concealable zipper slider of claim 1, wherein a tab is further connected to the nose body.

11. The concealable zipper slider of claim 10, wherein the tab has a pivoting end, the tab being pivotally connected to the nose body by the pivoting end.

12. A concealable zipper slider, comprising:

a slider body having a connecting portion and two longitudinally directed sliding slits, the sliding slits being respectively located at two sides of the connecting portion, the connecting portion having a longitudinally extended slit formed therein, the slit defining a dovetail shaped mortise; and a nose part having a nose body and a longitudinally extended base extending from a lower portion thereof, the base defining a dovetail shaped tenon, the base of the nose part being non-displaceably affixed in the slit of the slider body.

13. The concealable zipper slider of claim 12, wherein an end and a top of the connecting portion are open to the slit, and an end of the connecting portion forms two securing parts, the two securing parts bending inwardly to abut against an end of the base.

14. The concealable zipper slider of claim 12, wherein the nose part further includes a locking ring connected to an end of the nose body, the base being connected to a bottom of a connecting area between the nose body and the locking ring.

15. The concealable zipper slider of claim 14, wherein the locking ring forms a through hole.

16. The concealable zipper slider of claim 12, wherein the slider body and the nose part comprise different materials.

17. The concealable zipper slider of claim 12, wherein the slider body and the nose part are of different colors.

18. The concealable zipper slider of claim 12, wherein the slider body and the nose part are of a same material.

19. The concealable zipper slider of claim 12, wherein the slider body and the nose part are of a same color.

20. The concealable zipper slider of claim 12, wherein a tab is further connected to the nose body.

21. The concealable zipper slider of claim 20, wherein the tab has a pivoting end, the tab being pivotally connected to the nose body by the pivoting end.

* * * * *